US007188713B1

(12) United States Patent
Espar et al.

(10) Patent No.: US 7,188,713 B1
(45) Date of Patent: Mar. 13, 2007

(54) MAT, CARRIER COMBINATION

(76) Inventors: Traci Leigh Espar, 18137 Rosita St., Tarzana, CA (US) 91356; Jamie Michelle Yarow, 18137 Rosita St., Tarzana, CA (US) 91356

( * ) Notice: Subject to any disclaimer, the term of this patent is extended or adjusted under 35 U.S.C. 154(b) by 16 days.

(21) Appl. No.: 10/746,084

(22) Filed: Dec. 24, 2003

(51) Int. Cl.
*A45C 7/00* (2006.01)
*A45C 11/20* (2006.01)
*A45C 13/10* (2006.01)

(52) U.S. Cl. ..... 190/2; 190/107; 190/901; 383/2; 383/4; 5/417

(58) Field of Classification Search ..... 190/2, 190/107, 901, 1; 383/4, 2; 229/117.01; 5/417
See application file for complete search history.

(56) References Cited

U.S. PATENT DOCUMENTS 621,824 A * 3/1899 Kleeman ..... 190/107
841,902 A * 1/1907 Shumard ..... 190/107
888,653 A * 5/1908 Potter ..... 383/13
1,985,111 A * 12/1934 Shofer ..... 229/117.05
2,514,073 A * 7/1950 Karlson ..... 229/126
2,768,719 A * 10/1956 Morris et al. ..... 190/107
2,831,624 A * 4/1958 Lever ..... 383/4
2,908,020 A * 10/1959 Barton ..... 5/99.1
3,173,465 A * 3/1965 Pastini ..... 150/108
3,180,555 A * 4/1965 Barrett ..... 229/101
3,246,829 A * 4/1966 Stuart ..... 229/228
4,489,815 A * 12/1984 Martinez et al. ..... 190/1
5,016,813 A * 5/1991 Simons ..... 229/189
5,179,741 A * 1/1993 Book ..... 5/417
5,249,550 A * 10/1993 Hines et al. ..... 119/168
5,328,265 A * 7/1994 Clooney ..... 383/4
5,904,230 A * 5/1999 Peterson ..... 190/107
6,234,677 B1 * 5/2001 Mogil ..... 383/110
2002/0154834 A1 * 10/2002 Carty ..... 383/4

FOREIGN PATENT DOCUMENTS

JP 6191529 A * 7/1994

* cited by examiner

*Primary Examiner*—Sue A. Weaver
(74) *Attorney, Agent, or Firm*—Colin P. Abrahams

(57) ABSTRACT

A mat/carrier foldable between a substantially flat configuration and a storage configuration is provided. The mat/carrier comprises a mat/carrier component having a base panel, a plurality of side panels, and at least one intermediate panel intermediate adjacent side panels. A first set of folds separates each panel from its adjacent panels to facilitate re-orientation of each panel relative to its adjacent panels so as to form a container configuration. A second set of folds in at least some of the panels facilitate at least partial collapsing of the mat/carrier component from the container configuration to a smaller container configuration.

18 Claims, 7 Drawing Sheets

FIG. 10
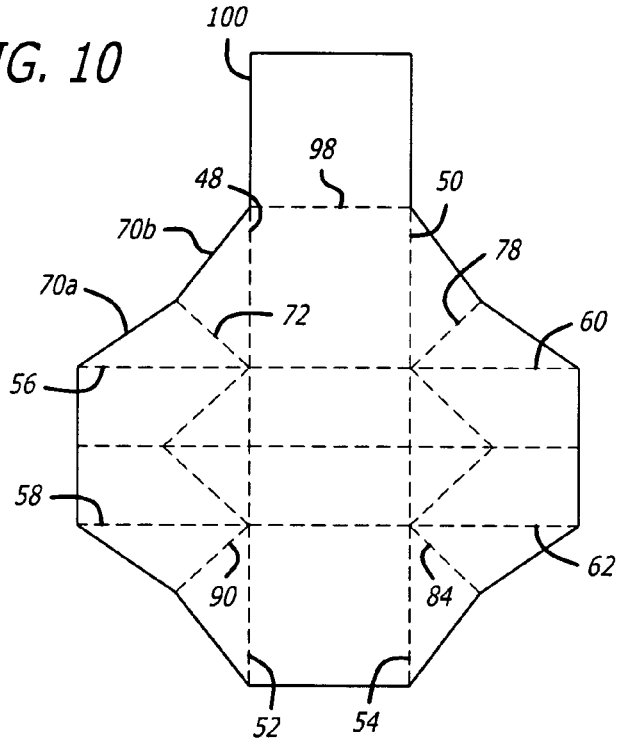
FIG. 11
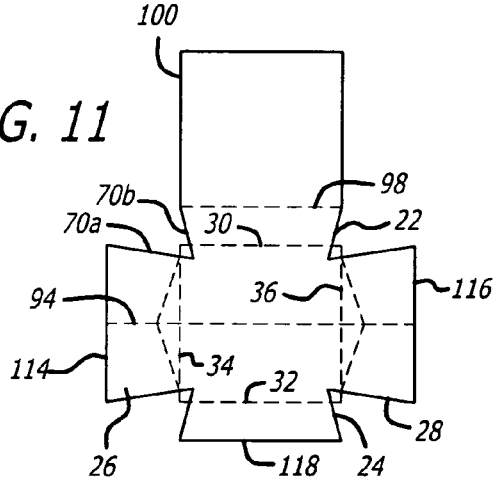
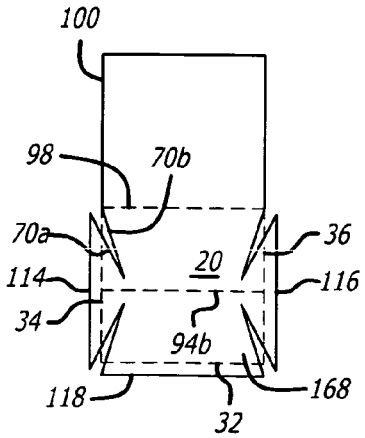
FIG. 12

MAT, CARRIER COMBINATION

FIELD AND BACKGROUND OF THE INVENTION

This invention relates to a mat and carrier combination. The mat and carrier combination of the invention is preferably a foldable mat, storage container and/or backpack combination. More particularly, the invention relates to a mat/carrier device having a configuration including a number of bend- or fold-lines, which enable the device to vary in shape between a substantially flat mat, a storage container which is achieved by folding along some of the bend- or fold-lines thereon, and a backpack, which is achieved by the folding of the device along additional or alternative fold- or bend-lines.

Preferably, the foldable mat and carrier of the invention is lightweight and easy to use, generally comprising an outer surface of nylon, fabric, plastic or other material, and a filler or cushion material therein.

While the mat and carrier combination of the invention may have many different applications, one significant use is that in relation to the storage of children's toys and supplies, so that these toys and supplies can be transported within the storage box configuration of the mat while in transit, and the mat opened for use by a child, especially an infant or toddler, when the device is not being used for storage purposes. As such, the invention is of particular use to mothers or child caregivers, providing a mat for the child, but also constituting a storage box and backpack which can be easily carried from one place to another as part of a child's necessary requirements.

While the invention has particular application with respect to children's needs, there are of course other applications of the invention, such as a storage container and mat for use on beaches, picnic areas, for exercising, for camping and the like.

Of course, ground mats, storage boxes and backpacks are well-known and widely used, and are available in a significant number of variations. Some of these devices are specifically designed for particular usages, and therefore have dimensions and configurations intended for the designed use. As regards ground mats for children, toddlers and others, such mats are often foldable for storage purposes, but would not typically have any other utility. Likewise, storage boxes are often collapsible, or capable of assembly, and of compact size and shape. For the most part, these mats, boxes and backpacks are generally discrete devices with a single purpose, and are typically utilized for that purpose.

SUMMARY OF THE INVENTION

According to one aspect of the invention, there is provided a mat/carrier foldable between a substantially flat configuration and a storage configuration, the mat/carrier comprising: a mat/carrier component having a base panel, a plurality of side panels, and at least one intermediate panel intermediate adjacent side panels; a first set of foldable members separating each panel from its adjacent panels, the first set of foldable members facilitating re-orientation of each panel relative to its adjacent panels so as to form a container configuration; and a second set of foldable members in at least some of the panels to facilitate at least partial collapsing of the mat/carrier component from the container configuration to a smaller container configuration.

Preferably, the mat/carrier component is substantially square in shape, the base panel is formed substantially centrally on the mat/carrier component and has four side edges, and the side panels comprise four side panels provided on each side edge of the base panel. Preferably, four intermediate panels are provided, with one intermediate panel being located between each side panel. Each intermediate panel may have a rounded edge and a cover panel may extend from the mat/carrier component.

In a preferred form, the foldable members comprise lines of reduced thickness on the mat/carrier component.

Intermediate panel foldable members may be provided to facilitate proper folding of the intermediate panels during reorientation between the mat configuration and container configuration. Further, releasable connector members may be provided for holding the side panels in a substantially fixed position relative to each other when the mat/carrier component is oriented in the storage configuration. Still further, the connector members may be used to connect the mat to connectors on other mats to make a composite larger mat.

Preferably, the second set of foldable members comprises a substantially linear foldable member extending across substantially the center of the base panel and across each of a side panel on each side of the base panel. Angled foldable members may also be provided on each of the side panels having the linear foldable member, the angled foldable members extending from opposing ends of the base panel toward the linear foldable member.

In one embodiment, the mat/carrier has a fastening mechanism on each side of the second foldable member in the base panel, the fastening mechanism securing to each other when the mat/carrier forms a smaller container configuration. The smaller container configuration may define a small storage space, or it may define substantially no storage space.

In accordance with one aspect of the invention, there is provided a mat, storage box and/or backpack combination, referred to generally in this specification as a foldable utility mat/carrier, which, based on a selected configuration, can be transformed from a mat to a container or box, from a container to a backpack, and from a backpack back to a mat, as may be desired by the user.

The foldable utility mat/carrier of the invention generally comprises a flat component having a pattern of foldable or bendable lines or members, and these are appropriately positioned to enable the flat component to be arranged so as to form a container box, and arranged differently or alternatively to form a substantially flat backpack-type structure for easy transport of materials and supplies. Straps may be provided on the flat component, so that, when folded into a backpack-type configuration, the straps will be positioned so as to be worn around the shoulders of the user.

Furthermore, a strap, and strap attachments, may be located on the flat component in appropriate positions, so that, when the flat component is formed into a box or container-shaped storage device, the straps, as well as the holders therefor, will be located such that the box can be conveniently carried using the straps.

Various toggles, connector pieces, press-studs, hook-and-eye, Velcro and other forms of fasteners may be positioned on the flat component so as to enable panels to be releasably connected together in order to retain the shape of the storage container and/or backpack to which the flat components may be transformed. Further, the flat component may also include a supplemental panel extending outwardly therefrom, the supplemental panel operating as a lid or cover for the storage container when the flat component is so arranged, and a closure flap or wall for the backpack, when in the backpack condition.

Preferably, the flat component is generally square in shape, preferably with rounded corners. In one embodiment, the flat component has folds or bends which divide the flat component into nine panels, the nine panels being made up of a substantially central panel having four sides, four lateral panels comprised of one lateral panel extending from each side of the central panel, and four corner or intermediate panels adjoining, or between, each adjacent lateral panel. In a preferred embodiment, these panels would be portions of the entire flat or mat component, and demarcated from each other by folds or bends.

Preferably, each intermediate panel also comprises a fold or bend so that when the central and lateral panels are moved between their various positions, the intermediate panels will fold in a predetermined manner.

Preferably, the flat component further comprises a linear horizontal fold-line extending through the middle of the central and two of the lateral panels adjacent thereto.

In a preferred embodiment, the flat component comprises an additional panel extending outwardly therefrom, the additional panel forming a lid or cover when the flat component is in the container type or back pack configurations. Preferably, the additional panel will be of the same dimensions as the central panel. Preferably, the additional panel will extend outwardly from one of the lateral panels, and such lateral panel from which it extends will not be a lateral panel through which horizontal fold-line, as described above, is located.

In a preferred form, the foldable utility mat/carrier of the invention comprises an upper sheet and a lower sheet of substantially the same dimensions, and connected at their edges. They may be connected at their edges by, for example, trim binding. Between these upper and lower sheets, there may be located foam, filler or other material which makes the utility mat/carrier of the invention soft and comfortable to sit or lie on. The sheets may be comprised of canvas, nylon, or any other suitable fabric.

The actual dimensions of the utility mat/carrier of the invention can vary widely so as to provide a larger mat, and concomitant larger storage box and backpack. Alternately, it may be of smaller dimensions so as to form a smaller container and/or backpack.

Preferably, the backpack mode of the mat/carrier of the invention may be in one of two configurations. A first configuration comprises a situation where the backpack is one so as to define an internal chamber or space in which objects or supplies may be stored. Such a configuration would have a greater depth. The second configuration is where the backpack is folded more compactly so that the utility mat/carrier of the invention is not able to contain almost any stored items, but is simply folded to its most compact form for transportation.

BRIEF DESCRIPTION OF THE DRAWINGS

In the drawings:

FIGS. 9 to 13 are schematic representations showing top views of the sequential folding steps of the panels of the utility mat/carrier of the invention from the open flat condition to the box condition with open lid;

DETAILED DESCRIPTION OF THE INVENTION

The present invention comprises a utility mat/carrier which essentially is formed a substantially flat mat component having a series of panels separated by bend- or fold-lines, the flat component being foldable along the bend- or fold-lines so as to form a storage box. In one form, the storage box can further be folded along bend-lines arranged in selected panels so as to compress the storage box to form a compacted folded mat, or backpack, which can be carried over the shoulders, by a handle or by a strap.

In a preferred embodiment, the backpack aspect of the utility mat/carrier may either be in a slightly expanded form so as to receive storage material, or in a more compacted form so as to render the utility mat/carrier into a small, convenient configuration for transportation.

In order to retain the utility mat/carrier in its various configurations, a series of strategically located fasteners are provided thereon so that, as the mat/carrier is folded from a flat mat condition to a storage condition, these fastening mechanisms can be used to keep the mat from falling open. The fastening members, as will be described with more particularity below, may vary according to the specific type of connection which will be made, but may comprise toggle or snap connections, Velcro™, press-studs, hook-and-eye arrangements, or any other mechanism which will achieve the desired connection.

Figure 1:
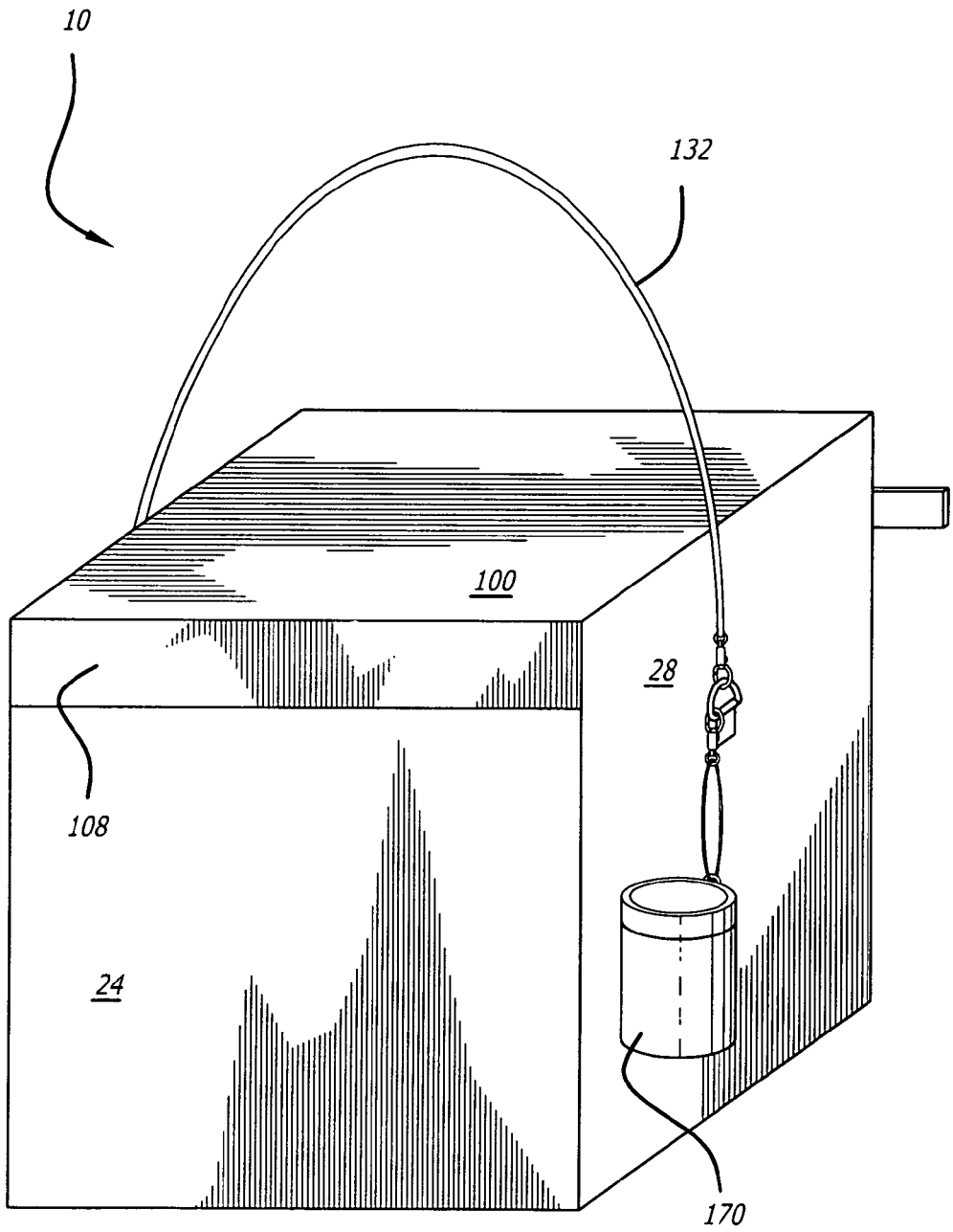
FIG. 1 is a perspective view of the utility mat/carrier of the invention, shown in the closed position.
Figure 2:
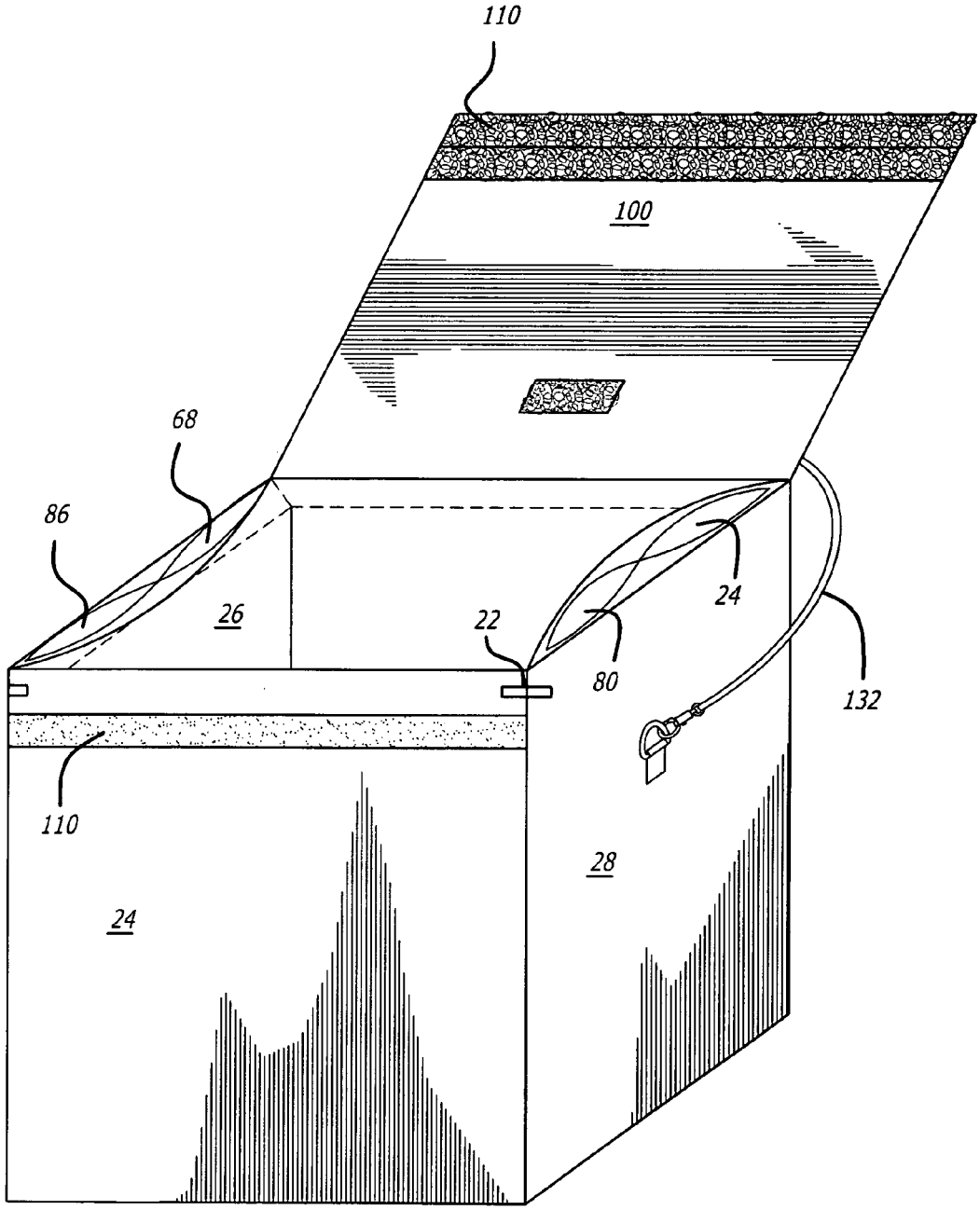
FIG. 2 is a perspective view of the utility mat/carrier shown in FIG. 1, with the lid opened.
Figure 4:
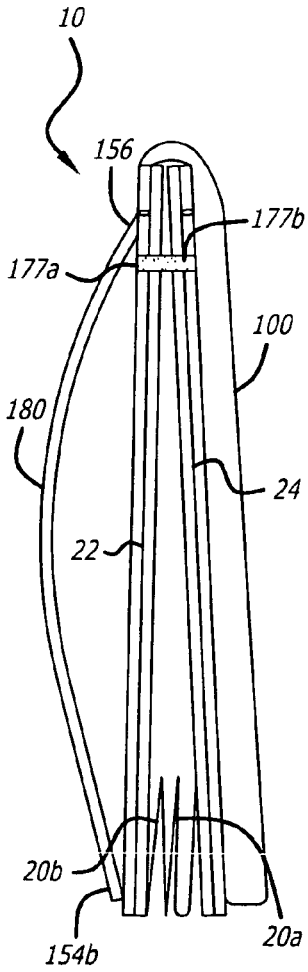
FIG. 4 is a side view of the utility mat/carrier of the invention to form a closed backpack.
Figure 7:
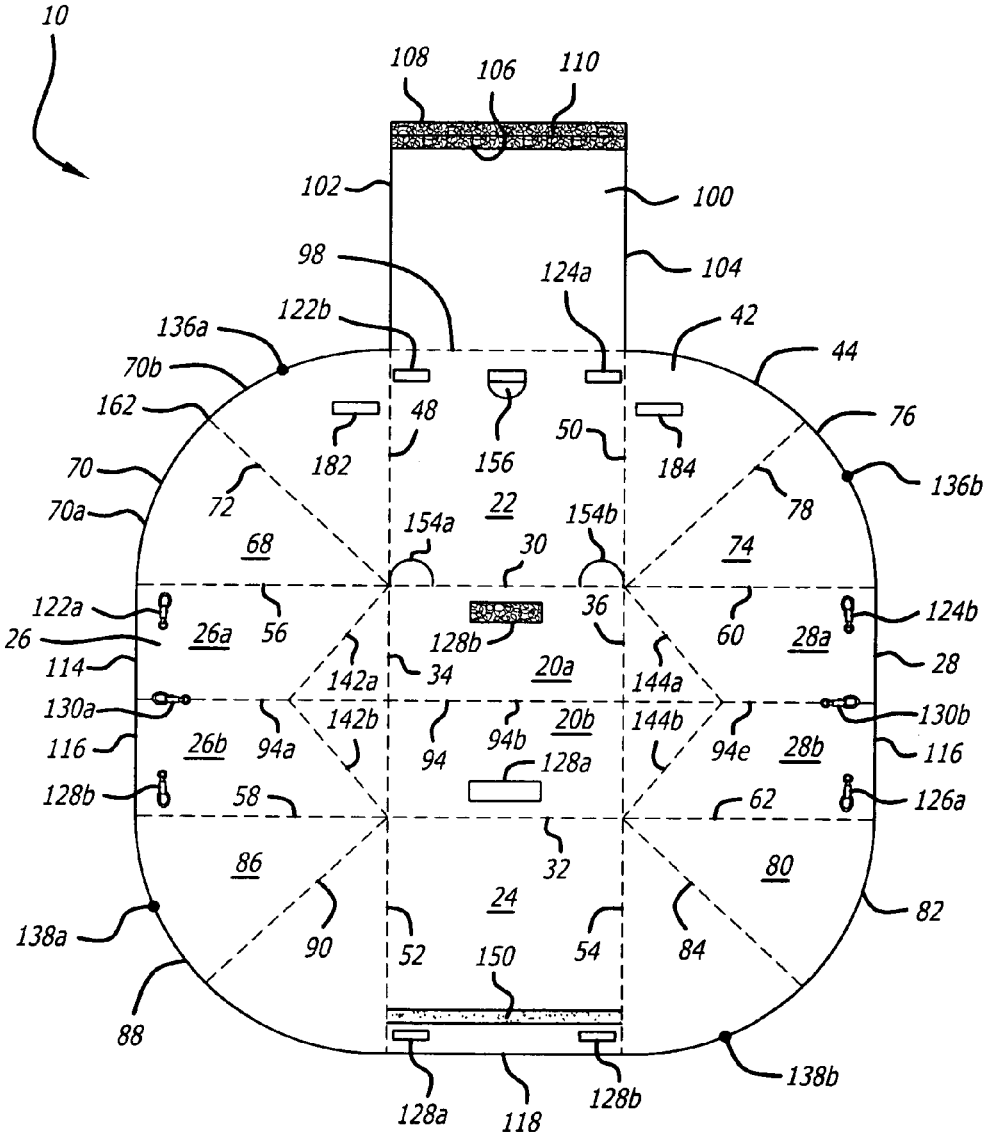
FIG. 7 is a bottom view of the utility mat/carrier of the invention in the completely unfolded or "mat" condition.
Figure 8:
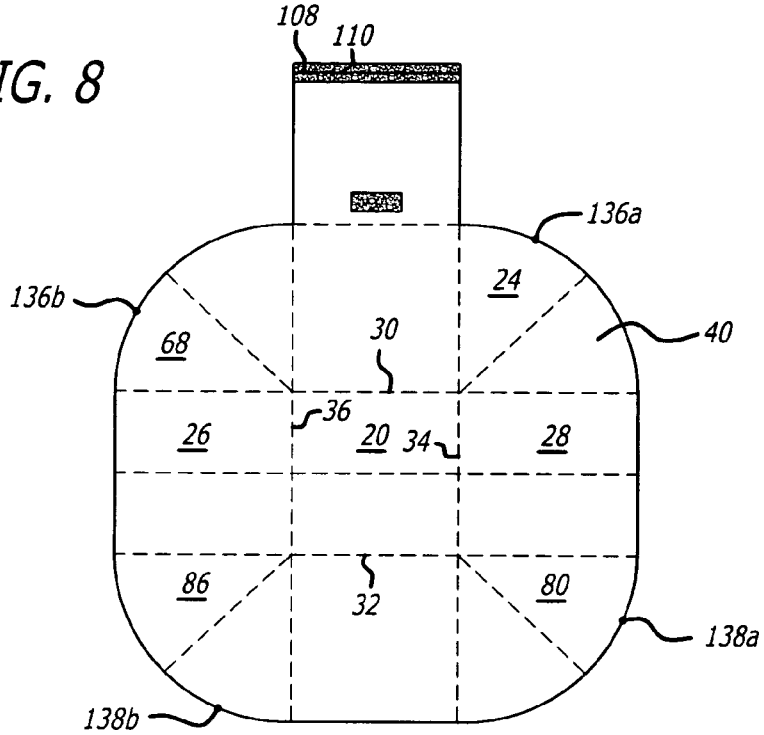
FIG. 8 is a top view of the utility mat/carrier of the invention shown in FIG. 7.

The utility mat/carrier of the invention is described with reference to the drawings, and, generally, FIG. 1 illustrates a perspective view of a mat/carrier 10, when folded into a storage container configuration. FIG. 1 shows this storage container with the lid closed. FIGS. 7 and 8 show the mat/carrier of the invention in the substantially opened or flat component position, FIG. 7 being a bottom view, illustrating many of the connections, and FIG. 8 being a top view. Both of these FIGS. 7 and 8 are useful in understanding how the various configurations of the utility mat/carrier 10 of the invention can be achieved, since they show different panels, bend-lines, and fastening mechanisms which enable the appropriate transformation. Finally, as a general overview, FIG. 4 shows a side view of the mat/carrier 10 of the invention in its configuration as a backpack. All of these different configurations are explained in further detail below, together with a description as to how the folding is carried out in order to obtain one of the desired configurations, namely, a flat mat, a storage container, and a backpack.

Specific reference is now made to FIGS. 7 and 8 of the drawings, and a detailed description of the configuration of a preferred embodiment of the invention will now be provided. FIG. 7 shows a bottom view, in the completely open position, while FIG. 8 shows a top view, also in the completely open position, of the mat/carrier 10 of the invention. The mat/carrier 10 of the invention is generally square in shape with rounded corners. There is provided a central panel 20, an upper panel 22, a lower panel 24, a first lateral panel 26 and a second lateral panel 28. The central panel 20 (as well as the upper, lower, first lateral and second lateral panels 22, 24, 26 and 28) are all square in shape and of substantially the same dimensions. The central panel has a fold 30 separating it from the upper panel 22, a fold 32 separating it from the lower panel 24, a fold 34 separating it from the first lateral panel 26 and a fold 36 separating it from the second lateral panel 28.

It should be noted throughout this specification that any reference made to "fold" or "folds" is intended to describe a line which may be structured or configured so as to facilitate folding between adjacent panels. Thus, the fold may be a line comprised of stitching, a thinning of the mat/carrier 10 of the invention, a heat sealed portion, or any other feature, structural or otherwise, which facilitates or allows two panels to be changed in orientation with respect to each other without causing "bunching" and/or edges which are not substantially straight.

The mat/carrier 10 of the invention has an upper surface 40 and a lower surface 42, comprising substantially coextensive sheets of nylon, fabric, plastic, canvas or the like. The upper and lower surfaces 40 and 42 are stitched or otherwise fastened together along their edges 44, to form the mat/carrier 10 of the invention. The upper and lower surfaces 40 and 42 may define a space therebetween, the space being filled with foam, filler, or any other substance which may afford a cushioning effect for the mat/carrier 10 of the invention, to provide for the comfort of the user.

The upper panel 22 has a fold 48 and a fold 50. The lower panel 24 has a fold 52 and a fold 54. The first lateral panel 26 has a fold 56 and a fold 58. The second lateral panel has a fold 60 and a fold 62. It will be noted that the folds 56, 30 and 60 are linear or continuous, as are the folds 58, 32 and 62. Likewise, the folds 48, 34 and 52 are linear or continuous, as are the folds 50, 36 and 54.

A corner panel 68 is formed between first lateral panel 26 and upper panel 22, and includes a rounded edge 70 and a radial fold 72. A corner panel 74 is formed between the upper panel 22 and the second lateral panel 28, and includes a rounded edge 76, and a radial fold 78. A corner panel 80 is formed between the lower panel 24 and second lateral panel 28, and a has a rounded edge 82 and a radial fold 84. Finally, corner panel 86 is formed between the lower panel 24 and the first lateral panel 26, and includes a rounded edge 88 and a radial fold 90.

A central fold 94 extends across the middle of the mat/carrier 10 of the invention, through the first lateral panel 26 (fold 94*a*), the central panel 20 (fold 94*b*) and the second lateral panel 28 (fold 94*c*). The central fold 94 is approximately mid-way or equidistant between the fold 30 and the fold 32.

The upper panel 22 has a cover fold 98, and a cover panel 100. The cover 100 is also of square shape, being of substantially the same dimensions as the central panel 20, upper panel 22, lower panel 24, first lateral panel 26 and second lateral panel 28. The cover 100 has side edges 102 and 104, and a top edge 106. Attached to the top edge is an elongate flap 108, with fastening means 110 thereon. As will be described below, the elongate flap 108 and fastening means 110 are used for closing the mat/carrier 10 of the invention when it is in a box configuration or used as a backpack.

The first lateral panel has a straight edge 114, the second lateral panel 28 has straight edge 116, while the lower panel 24 has a straight edge 118.

Various connectors are located on the mat/carrier 10. A connector 122*a* is formed on first lateral panel 26, and its corresponding connector 122*b* is formed on the upper panel 22. A connector 124*a* is formed on upper panel 22, and its corresponding connector 124*b* is formed on the second lateral panel 28. A connector 126*a* is formed on the second lateral panel 28, and its corresponding connector 126*b* is formed on the lower panel 24. A connector 128*a* is formed on the lower panel 24, and its corresponding connector 128*b* is formed on the first lateral panel 26. The connectors 122, 124, 126 and 128 are fastened together when the mat/carrier 10 is in the box and backpack condition to keep the various panels in position and to prevent them from falling open, as will be described.

The central panel 20 includes Velcro™ fastener 128*a* near the fold 32, and fastener 128*b* near the fold 30. As will be described, these two Velcro™ fasteners 128*a* and 128*b* attach to each other when the mat/carrier 10 is in the backpack position, in order to retain it in that position and prevent it from falling open.

The mat/carrier 10 further comprises strap connectors 130*a* and 130*b*. In the embodiment being described, these strap connectors 130*a* and 130*b* provide connection points for a strap 132, seen, for example, in FIG. 1 of the drawings, so that when the mat/carrier 10 is in the box configuration, the strap 132 can be used to lift and carry the box container.

Also provided are connectors 136*a* and 136*b* at or near the round edges 70 and 76 respectively. When the mat/carrier 10 is in the backpack condition, as will be described, these connectors 136*a* and 136*b* attach to each other to keep the folded corner panels 68 and 74 in a substantially fixed position.

Also provided are attachments 138*a* and 138*b* which are located at or near the rounded edges 88 and 82 respectively. These connectors 138*a* and 138*b* serve the same function as connectors 136*a* and 136*b*, but, of course, operate with respect to the corner panels 86 and 80.

In order to facilitate folding of the mat/carrier 10 from the box configuration to the backpack configuration, as will be described, the first lateral panel 26 has a fold 142*a* and a fold 142*b*. Correspondingly, the second lateral panel 28 has a fold 144*a* and 144*b*.

The lower panel 24 includes an elongate fastening strip 150, of substantially the same dimensions as fastening means 110 on the elongate flap 108. When the mat/carrier 10 is in the box configuration, the fastening means 110 is configured so as to attach to the fastening strip 150 so as to keep the cover panel 100 in a relatively fixed, but releasable, closed position.

Backpack fasteners 154*a* and 154*b* are provided on the upper panel 22, near the fold 30, on each side of the upper panel 22. Further, a backpack strap fastener 156, also provided in a central location on the upper panel 22, is formed near the cover fold 98. In use, a first strap or first portion of a strap extends between the fasteners 156 and 154*a*, and a second strap or second portion of a strap extends between the fasteners 156 and 154*b*. Together, these provide shoulder straps which enable the user to wear the mat/carrier 10 on the back as a backpack, over the shoulders, when the mat/carrier 10 is in the backpack configuration, as will be described.

Having described the various components, folds, attachment mechanisms and other features of the mat/carrier 10, as seen in the open or extended position of FIGS. 7 and 8, a description of the mechanism by means of which the mat/carrier 10 of the invention can be converted from the mat to the container form, and from the container to the backpack form, will now be described.

Figure 9:
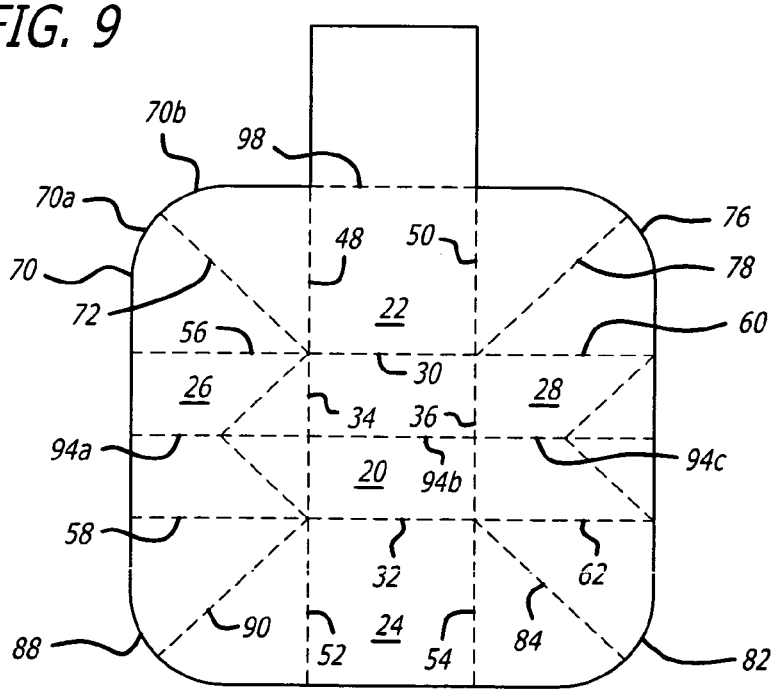

A schematic, sequential representation of the mat/carrier 10, as shown in FIGS. 7 and 8 of the drawings, showing how it is transformed into a container, is illustrated in FIGS. 9 to 13 of the drawings. FIG. 9 of the drawings shows a top view, in schematic form only, of the mat/carrier 10 in a similar position to that illustrated in FIG. 8 of the drawings. FIG. 9 therefore shows the mat/carrier 10 before folding commences.

In FIG. 10, the initial stage of converting the mat/carrier 10 from a mat configuration to a container configuration is illustrated. In this FIG. 10, each of the corner panels 68, 74, 80 and 86 is moved upward and folded inward. In FIG. 9 and the subsequent Figures, it will be appreciated that the mat is lying flat on a surface. Each of the corners panels 68, 74, 80 and 86 is thus moved upward, bending along their radial folds 72, 78, 84 and 90 respectively. As each of these corner folds 68, 75, 80 and 86 is moved upward, it will also be appreciated that the upper panel 22, lower panel 24, first lateral panel 26 and second lateral panel 28 also move upward. As a representative example of all the corner panels, specific reference is made to corner panel 68 which includes the rounded edge 70, having rounded portion 70*a* and 70*b*. These are separated by the fold point 162. The corner panel 68, as it is moved upward, causes the radial fold 72 to bend, and the folds 48 and 56 adjacent upper panel 22 and first lateral panel 26, also bend, causing the upper panel 22 and first lateral panel 26 to move upward.

Figure 13:
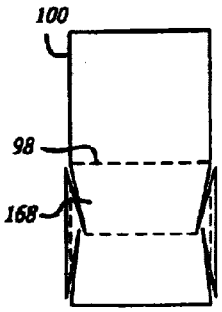

The upward movement of the various panels continues, as illustrated in FIG. 11 of the drawings. The rounded portions 70*a* and 70*b* of rounded edge 70 continue to extend inwardly, and in FIG. 11, are overlying the central panel 20, as a container with a space or chamber is being formed. In FIG. 12, the various corner panels 68,74, 80 and 86 are almost doubled over, and the upper panel 22, lower panel 24, first lateral panel 26 and second lateral panel 28 are almost in the vertical position. The central panel 20 has, essentially, not undergone any movement at all, as can be seen in FIG. 12 of the drawings. FIG. 13 shows the next sequential step wherein the upper panel 22, lower panel 24, first lateral panel 26 and second lateral panel 28 are essentially vertical, and the corner panels 68, 74, 80 and 86 are stored in a doubled-over manner within a space or chamber 168, which has now been formed by the change in the configuration. At the approximate folding stage represented by FIG. 13 of the drawings, connector 122*a* is fastened to connector 122*b*, connector 124*a* is fastened to connector 124*b*, connector 126*a* is fastened to connector 126*b*, and connector 128*a* is fastened to connector 128*b*. These various connectors are best seen in FIG. 7 and not shown in the schematic diagrams so that the folding sequences shown in FIGS. 9 to 21 will not be obscured. This essentially holds the panels in the position shown in FIG. 13, and prevents the mat/carrier 10, now in a box configuration, from falling open.

In FIG. 13, the cover 100 is shown in the open position, but is capable of pivoting or bending about the fold 98 so as to cover the chamber 168. The fastening means 110, when the cover 100 is closed or covers the chamber 168, attaches to the fastening strip 150. The elongate flap 108 bends relative to the cover 100, and folds over the straight edge 118 to engage the fastening strip 150.

FIG. 13 therefore essentially represents the last stage in the transformation of the mat/carrier 10 from the flat mat configuration to the container or box configuration. Further folding, as described with respect to FIGS. 14 to 16 results in the collapsing of the container as shown in FIG. 13, resulting in its transformation to a backpack configuration, as will now be described.

Figure 14:
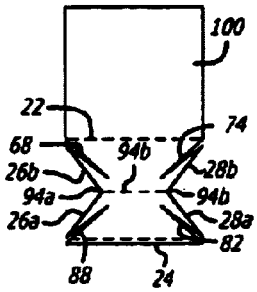
FIGS. 14 to 16 are schematic top views of the utility mat/carrier of the invention when being folded from a box condition to a backpack condition.

FIG. 14 shows the initial part of the collapsing from the box to the backpack. In this regard, the lower panel 24 is moved towards the upper panel 22, and the first lateral panel 26 and second lateral panel 28 begin to bend along that portion of the central fold 94 running along the length of the mat/carrier 10. The central fold 94 is designated as fold 94*a* in the first lateral panel 26, fold 94*b* in the central panel 20, and fold 94*c* in the second lateral panel 28.

Figure 15:
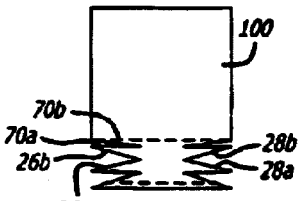
Figure 16:
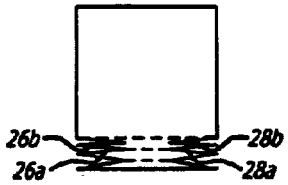

The first lateral panel 26 has panel portions 26*a* and 26*b* divided or separated from each other by the fold 94*a*. As the panel portion 26*a* folds inwardly, it sandwiches the folded corner portion 86 between itself and the lower panel 24. The panel portion 26*b* sandwiches the folded corner panel 68 between itself and the upper panel 22. On the other side, the second lateral panel 28 is divided into panel portions 28*a* and 28*b*. The panel portion 28*a* sandwiches the folded corner panel 80 between itself and the lower panel 24, while the panel portion 28*b* sandwiches the folded corner panel 74 between the second lateral panel 28 and the upper panel 22. As the lower panel 24 is moved toward to the upper panel 22, further compression takes place, as shown in FIG. 15. Finally, as shown in FIG. 16, all of the corner panels 74, 80, 86 and 68 are fully folded, as is each of the first lateral panel 26 and the second lateral panel 28. The cover 100 is shown in the open position, but can extend over the remainder of the mat/carrier 10, so as to close off the top of the now formed backpack aspect of the mat/carrier.

In one preferred embodiment of the invention, the backpack so formed, as shown in FIGS. 15 and 16, may define a somewhat larger chamber 168 shown in FIG. 15, and a small or the absence of a chamber 168 in FIG. 16. In the configuration in FIG. 15, folding has taken place to the extent necessary to form a backpack, but providing some space defining a chamber 168 in which certain flat items can be stored. However, if desired, further folding or compression can take place to essentially close off or substantially eliminate the chamber 168 so that the entire mat/carrier 10 of the invention simply becomes a somewhat solid backpack, easy for carrying, but unable to accommodate any articles for conveyance. The complete back pack configuration is kept in place with assistance from fasteners 182 and 184.

Figure 17:
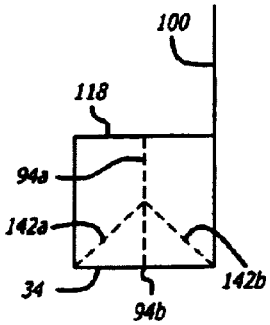
FIGS. 17 to 21 are schematic side views of the utility mat/carrier of the invention when being folded from a box condition to a backpack condition.
Figure 18:
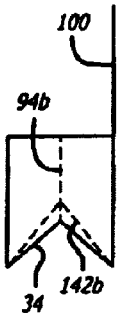
Figure 19:
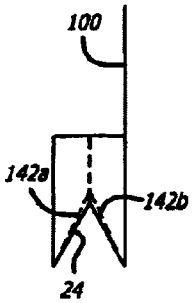
Figure 20:
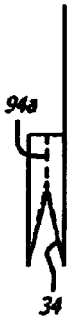
Figure 21:
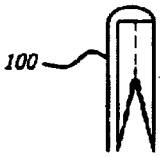

FIGS. 17 to 21 of the drawings show a side view of the folding process from the container to the backpack, the top view of which is illustrated in FIGS. 14 to 16. FIG. 17 shows the box or container prior to folding, with the chamber 168 at optimal size. FIGS. 17 to 21 show the operation and function of the central panel 20, which folds along its fold 94*b*, but also shows the function of the folds 142*a* and 142*b* in the first lateral panel 26, and correspondingly, the operation of the folds 144*a* and 144*b* in the second lateral panel 28 on the other side of the mat/carrier 10 (not specifically illustrated in FIGS. 17 to 21). As the central panel 20 folds upward along its fold 94*b*, the first and second lateral panel 26 and 28 fold along their fold-lines 94*a* and 94*c*. Eventually, panel portions 20*a* and 20*b* of the central panel 20 are folded alongside each other, and connect to each other by Velcro™ strip 128*a* and 128*b*. Likewise, portions 26*a* and 26*b* fold against each other, as do portions 28*a* and 28*b*. In FIG. 20, the mat/carrier 10 is shown almost completely folded, with the cover 100 open. Finally, FIG. 21 shows the situation where the cover 100 is moved so as to fall over the opening to the chamber 168, and lie adjacent the lower panel 24. The fastening means 110 engages the fastening strip 150, as already described.

From the above description, drawings and schematic illustrations, it will be seen how the mat/carrier 10 can be converted from a substantially flat mat configuration, shown in FIG. 7, to the container configuration shown in FIG. 13, to the backpack configuration shown in FIG. 21. In the box configuration, the connectors 136*a* and 136*b* attach or snap to the connectors 138*a* and 138*b* respectively.

Figure 3:
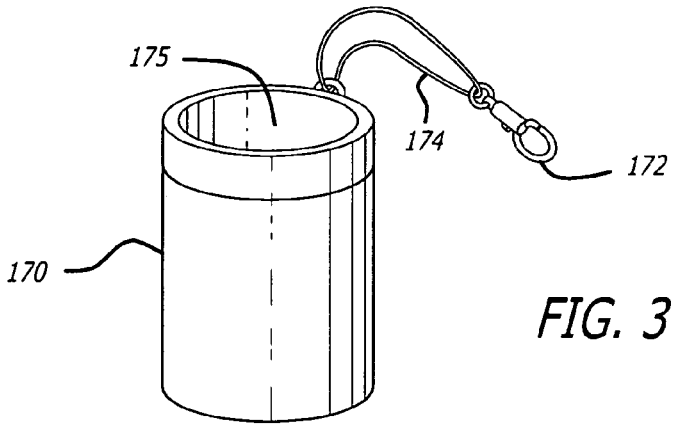
FIG. 3 is a perspective view of the container bag or pouch attachable to the utility mat/carrier in which smaller or personal items can be stored.

The mat/carrier 10 of the invention may also include an attachable carrying sack, 170, as shown in FIG. 1 of the drawings. The carrying sack 170 attaches to one of the strap connectors 130*a* or 130*b* (or both of them) to provide a receptacle which may conveniently accommodate small items which may become lost or difficult to retrieve if simply placed in the chamber 168. A detailed view of this carry sack 170 is shown in FIG. 3 of the drawings, and it includes a clasp 172 attached to a strap 174. The sack 170 has a drawstring 175.

FIG. 4 of the drawings shows, in less schematic form (as compared with FIGS. 17–21), a side view of a totally closed back pack. It will be seen that a straps 177*a*, 177*b* may be provided, to keep the various panels together, and attach to 150, and the chamber 168 closed. Further, a strap 180 is located between the connectors/attachments 156, 154*b*, and a pair of straps 180 (which may also be a single strap) allow the backpack to be slung over the shoulders for easy carrying thereof.

Figure 5:
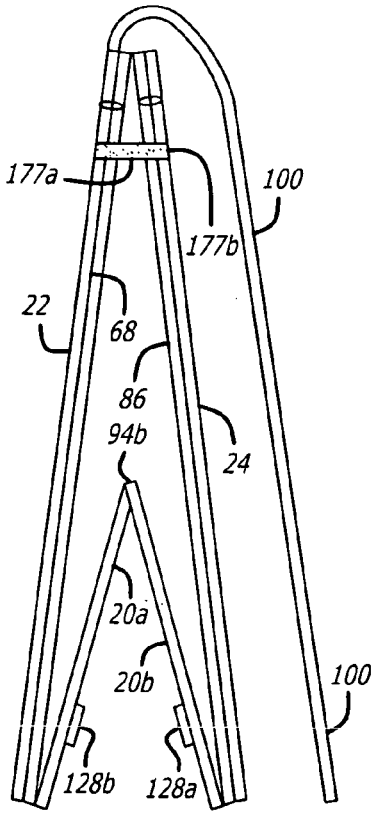
FIG. 5 is a side view of the utility mat/carrier as shown in FIG. 4, but only partially closed.
Figure 6:
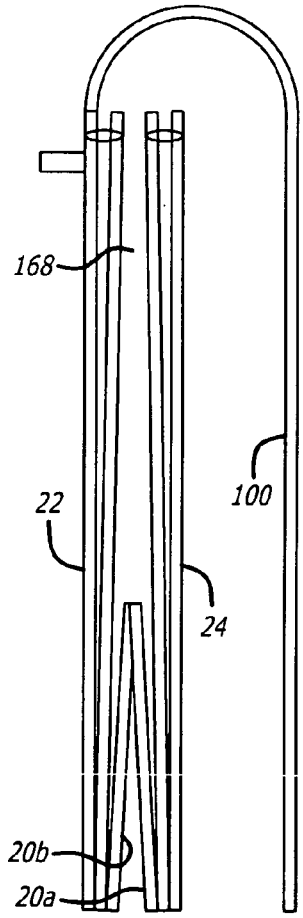
FIG. 6 is a side view of the utility mat/carrier of the invention shown in FIG. 4, but open, so as to provide a storage space within the backpack.

FIG. 5 shows a partially closed backpack, with the cover 100 closed. FIG. 6 shows the backpack not fully closed, but with the chamber 168 created as a small or flat chamber in order to provide a space in which articles may conveniently be stored when the mat/carrier 10 of the invention is able to function as a backpack.

The invention is not limited to the precise details described herein. Variations may be made with respect to size, shape of panels, and the position and nature of the folds, but all of these would of course be structured so as to allow the mat/carrier 10 to be adapted to a number of configurations, from a flat mat to a box to a compressed backpack form. Additionally, supplemental fastening mechanisms may be provided to keep the mat/carrier 10 in the desired position, or, alternatively, certain attachments may be omitted, as long as they do not compromise the function and adaptability of the mat/carrier 10.

The invention claimed is:

1. A mat and carrier foldable between a substantially unfolded flat configuration and a storage configuration, the mat and carrier comprising:

a mat and carrier component having a base panel, a plurality of side panels, and at least one intermediate panel intermediate adjacent side panels;

a first set of foldable members separating each panel from its adjacent panels, the first set of foldable members facilitating re-orientation of each panel relative to its adjacent panels so as to form a container configuration;

a second set of foldable members distinct from the first set of foldable members in at least some of the panels to facilitate at least partial collapsing of the mat and carrier component from the container configuration to a smaller container configuration, the mat and carrier component being selectively foldable and unfoldable between the unfolded flat configuration, the container configuration and the smaller container configuration the second set of foldable members comprising a substantially linear foldable member extending across substantially the center of the base panel and across each of a side panel on each side of the base panel; and a fastening mechanism on each side of the second foldable member in the base panel, the fastening mechanism securing to each other when the mat and carrier forms a smaller container configuration.

2. A mat and carrier as claimed in claim 1 wherein in the mat and carrier component is substantially square in shape, the base panel is formed substantially centrally on the mat and carrier component and has four side edges, and the side panels comprise four side panels provided on each side edge of the base panel.

3. A mat and carrier as claimed in claim 2 wherein four intermediate panels are provided, with one intermediate panel being located between each side panel.

4. A mat and carrier as claimed in claim 3 wherein each intermediate panel has a rounded edge.

5. A mat and carrier as claimed in claim 1 further comprising a cover panel extending from the mat and carrier component.

6. A mat and carrier as claimed in claim 5 wherein the cover panel further comprises an elongate strip with a fastening mechanism, the elongate stip folding over a panel such that the fastening mechanism can fasten to another panel.

7. A mat and carrier as claimed in claim 1 wherein the mat and carrier component comprises an upper surface and a lower surface, the upper and lower surfaces being substantially coextensive and fastened together at or near their edges, and a filler material is located between the upper and lower surfaces.

8. A mat and carrier as claimed in claim 7 wherein the filler material is selected from foam, filler, fabric.

9. A mat and carrier as claimed in claim 7 wherein the foldable members comprise lines of reduced thickness on the mat and carrier component.

10. A mat and carrier as claimed in claim 1 further comprising intermediate panel foldable members to facilitate proper folding of the intermediate panels during reorientation between the mat configuration and container configuration.

11. A mat and carrier as claimed in claim 1 further comprising releasable connector members for holding the side panels in a substantially fixed position relative to each other when the mat and carrier component is oriented in the storage configuration.

12. A mat and carrier as claimed in claim 1 further comprising attachment means on at least some of the side panels, and a strap for securing to the attachment means to enable the mat and carrier to be held for transport in the storage configuration.

13. A mat and carrier as claimed in claim 1 further comprising an attachment strap, and attachment members located on a side panel for holding the attachment strap, the attachment strap forming a shoulder strap whereby a user can transport the mat and carrier.

14. A mat and carrier as claimed in claim 1 further comprising angled foldable members on each of the side panels having the linear foldable member, the angled foldable members extending from opposing ends of the base panel toward the linear foldable member.

15. A mat and carrier as claimed in claim 1 wherein the smaller container configuration defines a small storage space.

16. A mat and carrier as claimed in claim 1 wherein the smaller container configuration defines substantially no storage space.

17. A mat and carrier as claimed in claim 1 further comprising at least one strap for securing the mat and carrier to hold it in the smaller container configuration.

18. A mat and carrier foldable between a substantially flat configuration and a storage configuration, the mat and carrier comprising:

a mat and carrier component having a base panel, and a plurality of side panels;

a first set of foldable members separating each panel from its adjacent panels, the first set of foldable members facilitating re-orientation of each panel relative to its adjacent panels so as to form a container configuration;

a second set of foldable members in at least some of the panels to facilitate at least partial collapsing of the mat and carrier component from the container configuration to a smaller container configuration, the mat and carrier component being selectively foldable and unfoldable between the unfolded flat configuration, the container configuration and the smaller container configuration, the second set of foldable members comprising a substantially linear foldable member extending across substantially the center of the base panel and across each of a side panel on each side of the base panel; and a fastening mechanism on each side of the second foldable member in the base panel, the fastening mechanism securing to each other when the mat and carrier forms a smaller container configuration.

* * * * *